US006435673B1

(12) United States Patent
Hattori et al.

(10) Patent No.: US 6,435,673 B1
(45) Date of Patent: Aug. 20, 2002

(54) LIQUID CONTAINER, METHOD OF MANUFACTURE THEREFOR, INK JET CARTRIDGE THAT USES SUCH CONTAINER, AND INK JET RECORDING APPARATUS

(75) Inventors: Shozo Hattori, Tokyo; Hidehisa Matsumoto, Kawasaki, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/597,805

(22) Filed: Jun. 19, 2000

(30) Foreign Application Priority Data

Jun. 24, 1999 (JP) ..... 11-178568
May 30, 2000 (JP) ..... 2000-160402

(51) Int. Cl.[7] ..... B41J 2/175
(52) U.S. Cl. ..... 347/86
(58) Field of Search ..... 347/85, 86, 87, 347/49; 222/99, 100

(56) References Cited

U.S. PATENT DOCUMENTS 6,022,102 A * 2/2000 Ikkatai et al. ..... 347/85

FOREIGN PATENT DOCUMENTS

EP 738 605 * 10/1996
JP 2001-063759 A * 3/2001

* cited by examiner

*Primary Examiner*—Michael Nghiem
(74) *Attorney, Agent, or Firm*—Fitzpatrick, Cella, Harper & Scinto

(57) ABSTRACT

A liquid container of the present invention is substantially in polyhedral form with the corners formed by the corners of the extended portions of the three planes of the polyhedron form. The container including outer walls having strength to form a housing, inner walls having the outer plane equal to or analogous to the inner plane of the outer walls with the corners corresponding to the corners of the outer walls to form a liquid containing portion capable of containing liquid in the interior formed thereby, having strength smaller than that of the outer walls, and a liquid supply portion for supplying liquid contained in the liquid containing portion to the outside. Then, for this liquid container, the liquid supply portion is sealed only by the inner walls. With the liquid container thus structured, it is possible to prevent liquid leakage more reliably without using the sealing tape, cap, or the like at the time of distribution for delivery.

14 Claims, 9 Drawing Sheets

FIG. 2A1
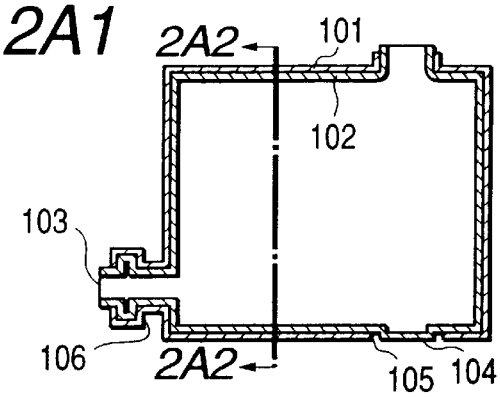
FIG. 2A2
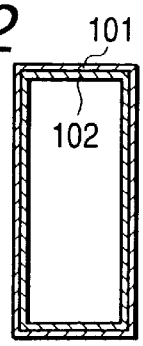
FIG. 2B1
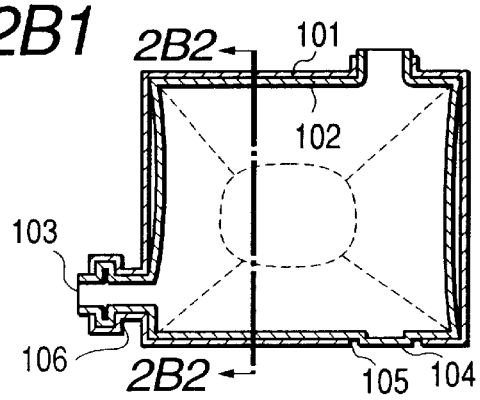
FIG. 2B2
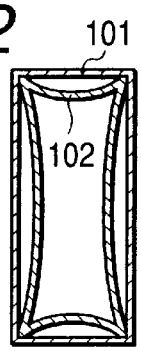
FIG. 2C1
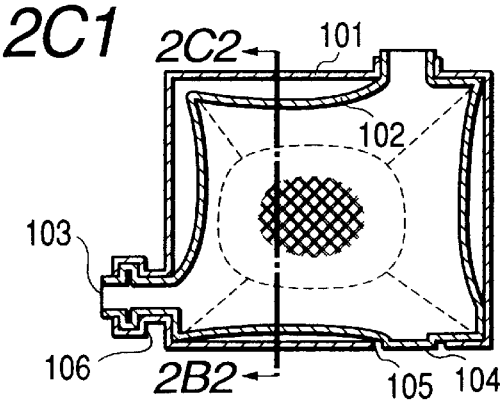
FIG. 2C2
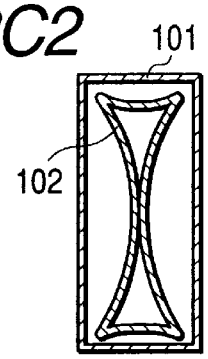
FIG. 2D1
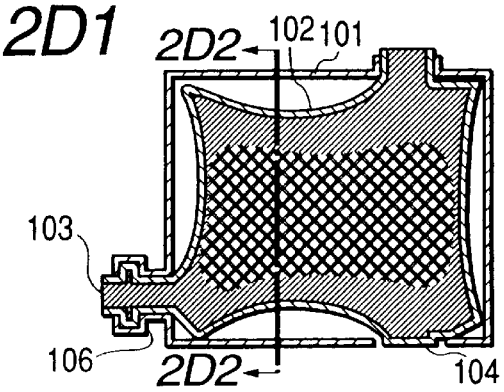
FIG. 2D2
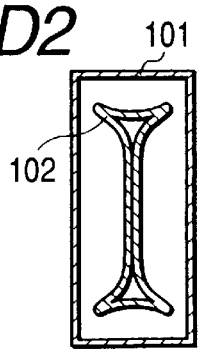

FIG. 8A1
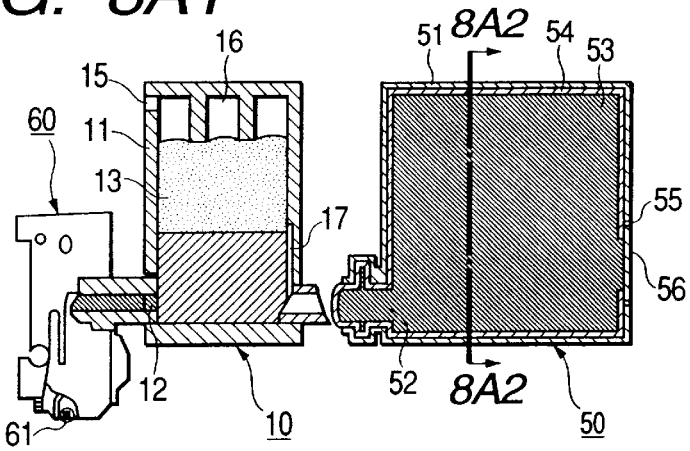
FIG. 8A2
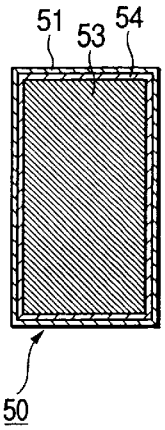
FIG. 8B1
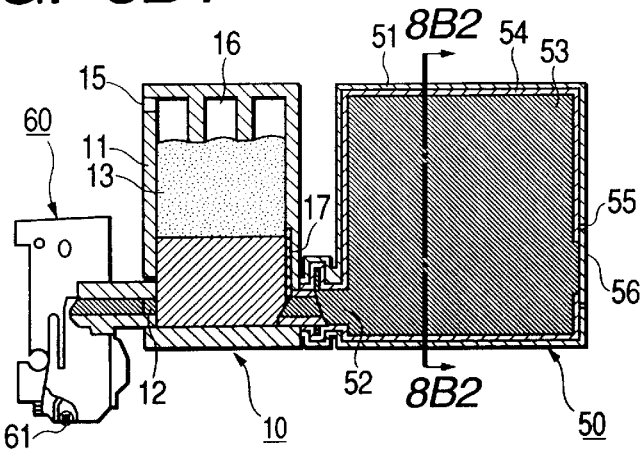
FIG. 8B2
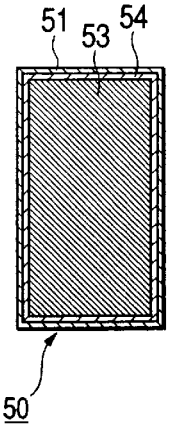
FIG. 8C1
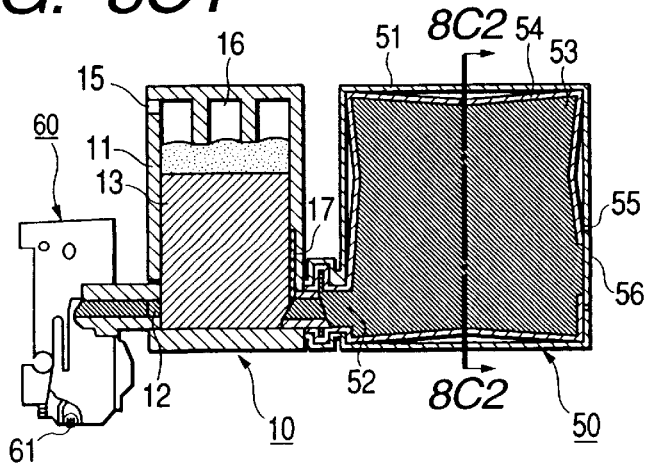
FIG. 8C2
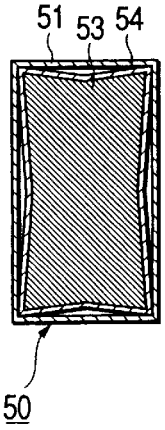

LIQUID CONTAINER, METHOD OF MANUFACTURE THEREFOR, INK JET CARTRIDGE THAT USES SUCH CONTAINER, AND INK JET RECORDING APPARATUS

BACKGROUND OF THE INVENTION

1. Field of the Invention

The present invention relates to a liquid container that utilizes negative pressure for supplying liquid to the members outside the liquid container, such as an ink discharge unit. The invention also relates to a method of manufacture therefor, an ink jet cartridge that uses such container, and an ink jet recording apparatus. More particularly, the invention relates to the field of ink jet recording to which is applicable an ink tank manufactured by blow molding the ink tank itself.

2. Related Background Art

In recent years, along with the miniaturization of an ink jet recording apparatus, an ink tank is installed on the carriage or a structure is adopted so that an ink tank unit is detachably installed on the recording head in order to reduce running costs.

An ink tank of the kind needs an airtight sealing to prevent ink leakage from the supply port when physically distributed for delivery or to prevent ink from being evaporated. As regards this sealing, it has been conventionally practiced in general to apply a sealing tape to or provide a cap member for the supply port portion.

In a case of the sealing arrangement of the kind, the user removes the sealing member when the ink tank is used. The sealing tape or the cap member thus removed is discarded as it is, thus presenting the problems related to environments and costs as well.

Also, depending on the sealing structure, there is still a possibility that ink leaks or ink evaporates due to the unexpected removal of a sealing member at the time of physical distribution for deliver.

SUMMARY OF THE INVENTION

It is an object of the present invention to provide a replaceable liquid container (ink tank) having a simple sealing structure capable of preventing ink leakage or the like at the time of distribution for delivery, and also, presenting no wasted substance when it is used.

It is another object of the invention to provide a method for manufacturing the liquid container for which the sealing structure thereof can be manufactured by a simple method at low costs.

It is still another object of the invention to provide an ink jet recording apparatus capable of mounting such liquid container thereon.

In order to achieve the objects described above, the liquid container of the present invention is substantially in a polyhedral form with the corners formed by the extended portions of the tree planes of the polyhedron, which comprises outer walls having strength to form a housing; inner walls having the outer plane equal to or analogous to the inner plane of the outer walls with the corners corresponding to the corners of the outer walls to form a liquid containing portion capable of containing liquid in the interior formed thereby, having strength smaller than that of the outer walls; and a liquid supply portion for supplying liquid contained in the liquid containing portion to the outside. Then, for this liquid container, the liquid supply portion is sealed only by the inner walls.

Also, the method of the present invention for manufacturing a liquid container formed by a polyhedral section, which is provided with outer walls having strength to form a housing; inner walls having the outer plane equal to or analogous to the inner plane of the outer walls with the corners corresponding to the corners of the outer walls to form a liquid containing portion capable of containing liquid in the interior formed thereby, having strength smaller than that of the outer walls; a liquid supply portion for supplying liquid contained in the liquid containing portion to the outside; and a liquid injection inlet for injecting liquid into the liquid containing portion, comprises the steps of preparing a first parison for use of the first walls and a second parison for use of the outer walls; forming the inner walls and the outer walls to be substantially analogous by injecting the air inside to expand the first and second parisons along dies; peeling off the inner walls from the outer walls; and forming the liquid supply portion by cutting a part of the outer walls.

Also, in order to achieve the objects described above, the present invention provides an ink jet cartridge that uses the aforesaid container, as well as an ink jet recording apparatus.

The ink jet cartridge of the present invention comprises a liquid container for containing liquid; and a recording head unit connected with the liquid container for discharging liquid in accordance with recording signals. Then, for this ink jet cartridge, the recording head unit is provided with a recording head for discharging liquid; a chamber for containing a negative pressure generating member having a liquid supply portion for supplying liquid to the recording head, and an atmospheric communication unit communicated with the air outside to contain therein a negative pressure generating member capable of retaining liquid in the interior thereof, and also, the liquid container is provided with outer walls in a substantially polyhedral form, having corners formed by extended portions of the three planes of the polyhedron, at the same time, having strength to form a housing; inner walls having the outer plane equal to or analogous to the inner plane of the outer walls with the corners corresponding to the corners of the outer walls to form a liquid containing portion capable of containing liquid in the interior formed thereby, having strength smaller than that of the outer walls; and a liquid supply portion for supplying liquid contained in the liquid containing portion to the outside. This liquid supply portion is sealed only by the inner walls, and at the same time, the liquid container is made attachable to and detachable from the chamber for containing a negative pressure generating member.

Also, the ink jet recording apparatus of the present invention comprises an ink jet cartridge provided with a liquid container for containing liquid, and a recording head unit connected with the liquid container for discharging liquid in accordance with recording signals; and a carriage having the cartridge detachable mounted thereon to perform scanning. For this ink jet recording apparatus, the liquid container is provided with outer walls in a substantially polyhedral form, having corners formed by extended portions of the three planes of the polyhedron, at the same time, having strength to form a housing; inner walls having the outer plane equal to or analogous to the inner plane of the outer walls with the corners corresponding to the corners of the outer walls to form a liquid containing portion capable of containing liquid in the interior formed thereby, having strength smaller than that of the outer walls; and a liquid supply portion for supplying liquid contained in the liquid containing portion to the outside. This liquid supply portion is sealed only by the inner walls, and at the same time, when the liquid container is installed on the recording head, the detaching thereof from the recording head is prohibited until liquid in the interior thereof is no longer present.

In accordance with the present invention structured as described above, the liquid supply port, through which liquid contained in the liquid containing portion is supplied to the outside, is sealed only by the inner walls that form the liquid containing portion. Therefore, when the liquid container is installed on the recording head, the inner walls of the liquid supply port are broken by the ink supply tube provided for the recording head. Thereafter, it is prohibited to detach the liquid container and the recording head until liquid in the liquid container no longer exists.

Thus, it becomes possible to prevent liquid leakage without the sealing tape, cap, or the like to be used for the liquid container at the time of distribution for delivery. Also, the liquid leakage is prevented when the liquid container is used, because the detachment of the liquid container and the recording head is prohibited until liquid in the container no longer exits.

BRIEF DESCRIPTION OF THE DRAWINGS

FIGS. 2A1, 2B1, 2C1 and 2D1 are views which illustrate changes when ink is contained in the ink tank shown in FIG. 1, and led out from the ink tank supply unit of the ink tank.

FIGS. 2A2, 2B2, 2C2, and 2D2 are cross-sectional views which correspond to FIGS. 2A1, 2B1, 2C1, and 2D1, respectively.

FIG. 6A is a schematic view shoring the recording head serving as recording means connectable with the ink tank; FIG. 6B is a cross-sectional view which shows the connecting condition between the recording head and the ink tank.

FIG. 7A is a perspective view, and FIG. 7B is a cross-sectional view when the ink tank is connected with the recording head.

FIGS. 8A1, 8B1, and 8C1 are views which illustrate one example schematically as to changes in each chamber in the order of FIGS. 8A1, 8B1, and 8C1 when the ink containing chamber of the ink tank is connected with the chamber for containing negative pressure generating member shown in FIGS. 7A and 7B.

FIGS. 8A2, 8B2, and 8C2 are cross-sectional views corresponding to FIGS. 8A1, 8B1, and 8C1, respectively.

DETAILED DESCRIPTION OF THE PREFERRED EMBODIMENTS

Hereinafter, with reference to the accompanying drawings, the embodiments of the present invention will be described.

First Embodiment

Figure 1:
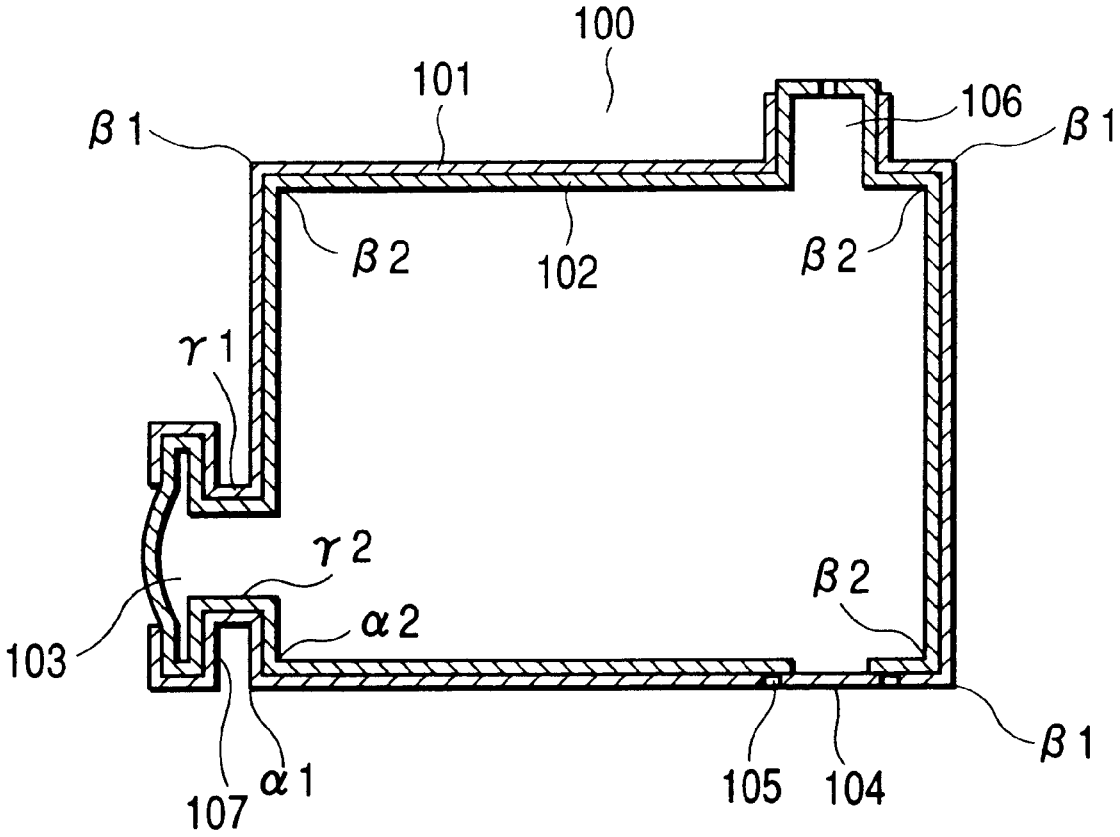
FIG. 1 is a view which schematically shows the structure of the ink tank of a liquid container in accordance with a first embodiment of the present invention.

FIG. 1 is a view which schematically shows the structure of the ink tank of a liquid container in accordance with a first embodiment of the present invention. FIGS. 2A1, 2B1, 2C1 and 2D1 are views which illustrate changes when ink is contained in the ink tank shown in FIG. 1, and led out from the ink tank supply unit of the ink tank. FIGS. 2A2, 2B2, 2C2, and 2D2 are cross-sectional views which correspond to FIGS. 2A1, 2B1, 2C1, and 2D1, respectively.

For the ink tank 100 shown in FIG. 1, a reference numeral 101 designates the outer walls of the ink tank, and 102, the inner walls of the ink tank. Ink is contained in the ink containing portion which is the area surrounded by the inner walls 102. Also, the outer walls 101 protect the ink containing portion so as not to allow the ink contained in the ink containing portion to leak outside due to any unexpected deformation of the inner walls.

A reference numeral 103 designates the supply unit of ink from the interior of the container to the outside, which becomes the connecting portion with the ink induction unit of an ink jet head side (not shown).

For the ink tank of the present embodiment, the corners of the inner walls (corners being defined later) correspond to the corners of the outer walls in the initial state to make the inner walls 102 of the ink tank analogous to the outer walls 101 thereof. Then, the ink tank inner walls 102 can follow the shape of the ink tank outer walls 101 serving as housing with a specific gap between them. In other words, it becomes possible to eliminate the dead space that may exist inevitably when a bag container is contained in the interior of the conventional housing. Thus, the capacity of ink per unit volume inside the outer walls of the ink tank is increased (the ink containing efficiency is made higher).

A reference numeral 104 designates the pinch off portion for the inner walls 102 to form a closed space. The pinch off portion 104 is formed when the parison is pinched by a metallic die for forming the ink tank walls at the time of blow molding. The inner walls 102 are welded themselves, and the outer walls 101 are closely in contact in a coupled form to dually function as the supporting portion to support the inner walls 102 to be described later. In accordance with the present embodiment, the shape of the pinch off portion 104 is linear when observed from the side face, but this portion is not necessarily in the simple linear form if only the ink tank can easily removed from the mold in the manufacturing process which will be described later. Also, its length is not necessarily limited to the one described herein unless this portion does not project from the side face.

A reference numeral 105 designates the atmospheric communication port through which the air outside is induced into the gap between the inner walls 102 and the outer walls 101 when deformation takes place as the volume is reduced along with the consumption of ink in the interior of the inner walls 102. This port can be either a simple opening or structured with an opening and an air flow valve. The mode shown in FIG. 1 is the one in which the atmospheric communication portion is a simple opening.

A reference numeral 106 designates the ink injection inlet through which ink is injected, which is positioned on the plane which orthogonal to the plane where the ink supply port 103 exists from the viewpoint of manufacture which will be described later. Also, its position may be on the upper face of the ink tank or the lower face thereof, but it is preferable to use the upper face as in the present embodiment with the aspect of ink remainders in view.

A reference numeral 103 designates the ink supply port which becomes the connecting portion with an ink jet head.

The portion thus connected has the inner wall 102 which are exposed, and ink is airtightly sealed.

The inner walls 102 is broken when the ink induction portion on the ink jet side is inserted to make it possible to lead out ink in the ink container, while keeping the airtight condition.

Also, when the ink induction portion on the ink jet side is inserted, the inner walls 102 of the ink supply port 103 receives pressure. Here, however, the inner wall receptacle 107 is arranged in a stepping form in order to prevent it from falling into the ink tank 100.

For the present embodiment, the inner wall receptacle 107 is formed with one step, but it is possible to prevent the inner walls 102 from falling more reliably with steps arranged in plural numbers.

Here, in FIG. 1, the inner walls 102 are schematically shown with one layer. For the present embodiment, however, an inseparable three-layer structure is adopted. The innermost layer of the inner walls 102, which is in contact with liquid, uses polypropylene as its material. The intermediate layer is formed by ring olefin copolymer as the layer material that governs the elastic modulus. For the outermost gas barrier layer, EVOH (saponified EVA—ethylene vinyl acetic copolymer resin) is used. Here, it is preferable to contain functional bonding resin material in the layer the governs the elastic modulus. Then, it becomes unnecessary to provide any particular bonding layer between layers, which enables the thickness of the inner walls 102 to be made smaller. As the material of the outer walls 101, polypropylene is used the same as the innermost layer of the inner walls 102.

In this respect, FIGS. 1, 2A1 to 2D1 and 2A2 to 2D2 are schematic views, in which the positional relationship between the outer walls 101 and inner walls 102 of the ink tank is represented as if parting from each other with a space. In practice, it should be good enough if only the outer and inner walls are separable, and there is no problem even if the inner and outer walls are in contact or the structure is arranged so as to arrange them with a slight space between them. Therefore, in either case, the ink tank is formed so that along the inner contour of the outer walls 101, the corners $\alpha 2$ and $\beta 2$ of the inner walls 102 are placed in the positions to face at least the corners $\alpha 1$ and $\beta 1$ of the outer walls 101 (FIGS. 2A1 and 2A2).

Here, for the ink tank structured with a body of almost polyhedron, each corner means to include at least three faces or more preferably, an intersecting portion where three faces intersect each other, or to include the portion that corresponds to the intersecting portion of the extended faces thereof. As to the reference marks of the corner portions, a means the corners to be formed on the surface where the ink supply port exists, and $\beta$ means the other corners. The subscript 1 indicates the outer wall, and the subscript 2 indicates the inner wall. Also, the ink supply unit is formed to be almost cylindrical, but given the intersecting portion formed by the curved face of the cylinder and the essentially flat faces as $\gamma$, the outer and inner walls are positioned to face each other in this intersecting portion, each of which is indicated by $\gamma 1$ and $\gamma 2$ hereunder, respectively. In this respect, it may be possible to arrange the structure so that minutely curbed faces are provided for each of the corners. In this case, the definition of faces is made with the minutely curved portions of the polyhedron as corners, and those other than the minutely curved portions as flat faces.

When ink consumption begins in the ink container following the ink discharges from the ink jet recording head which serves as ink jet recording means, the inner walls 102 begins to be deformed from the central portion of the surface having the maximum area in the direction in which the volume of the ink container is being reduced. Here, the outer walls functions to suppress the deformation of the corners. Since the ink tank herein has almost no positional displacement at the corners sectioned by the aforesaid corners $\alpha 2$ and $\beta 2$, the ink container receives both the acting force that creates deformation due to ink consumption, and the acting force that trends to restore it to the shape in the initial condition, which works in the direction to stabilize negative pressure eventually.

At this juncture, the air is induced form the atmospheric communication port 105 into the gap between the inner walls 102 and the outer walls 101, and functions to maintain the stabilized negative pressure when ink is used without impeding the deformation of the inner walls. In other words, the space between the inner walls and the outer walls is communicated with the air outside through the atmospheric communication port 105. Thereafter, with the balance between the force exerted by the inner walls, and the force created by the meniscus on each of the discharge ports of the ink head, ink is held in the ink container (FIGS. 2B1 and 2B2).

When a considerable amount of ink in the ink container is led out to the outside (FIGS. 2C1 and 2C2), the ink container is deformed in the same manner as described above, and the corruption of the central portion, which is directed inward stably, is maintained for the ink container. Therefore, the pinch off portion 104 also functions to regulate the deformation of the inner walls, and on the area adjacent to the one which has the maximum area, the portion where no pinch off 104 is provided begins to be deformed relatively earlier than the area where the pinch off is provided, hence parting from the outer walls.

However, there is still a fear that ink contained in the ink container is not consumed completely with full satisfaction, because only with the portions that regulate the deformation of inner walls as described above, the inner walls in the vicinity of the ink supply portion are deformed to block this supply portion eventually.

In accordance with the present invention, the corner $\alpha 2$ of the inner walls shown in FIG. 1 is formed along the corner $\alpha 1$ of the outer walls in the initial condition. Then, when the inner walls are deformed, the corner $\alpha 2$ of the inner walls is more difficult to be deformed than the other portion of the inner walls, thus making it possible to regulate the deformation of the inner walls. In this respect, each angle formed by the plural corners $\alpha 2$ of the inner walls is represented to be 90° for the ink tank herein.

Here, the angle of the corner $\alpha 2$ of the inner walls is defined to be the angle formed by two planes of at least three planes which make essentially a plane shape that constitutes the corner $\alpha 1$ of the outer walls, that is, the angle of the intersecting portion formed by two extended planes. The reasons that the angle of the corner of the inner walls is defined by the angle of the corner of the outer walls are that the outer walls are the criterion of the manufacture in the manufacturing process to be described later, and then, the inner walls and the outer walls are almost analogous to each other in the initial condition as described earlier.

Then, in FIGS. 2C1 and 2C2, the corner $\alpha 2$ of the inner walls is positioned to face the corner $\alpha 1$ of the outer walls in separable condition as shown in FIG. 1. On the other hand, the corners $\beta 2$ of the inner walls other than the corners formed by the planes where the ink supply port is formed are slightly apart from the corresponding corners β1 of the outer walls as compared with the corner α2. However, in accordance with the embodiment shown in FIGS. 1, 2A1 to 2D1 and 2A2 to 2D2, the angle of those at β in the facing positions is often formed at an angle less than 90°. Therefore, as compared with area of the other inner walls that form the ink container, it is possible for them to keep the positional relationship with the facing outer walls in a condition which is closer to the one in the initial condition. In this manner, the auxiliary support of the inner walls is implemented.

Further, in FIGS. 2C1 and 2C2, the planes that face the maximum surface area which will be described later are deformed almost simultaneously. As a result, the central portions of the ink container are allowed to be in contact with each other. The contacted central portions (indicated by slanted lines in FIGS. 2C1 and 2D1) are caused to expand wider as ink is led out more. That is, in accordance with the present invention, when ink is being led out, the plane having the maximum area of the ink tank is allowed to be in contact with the opposing plane before bending the edge which is formed by the plane having the maximum area and the plane adjacent thereto.

Sooner or later, ink contained in the ink container is consumed almost completely (hereinafter, this condition is referred to as the last condition), which is shown in FIGS. 2D1 and 2D2.

In this condition, the contacted portion of the ink container has expanded substantially to the entire area of the ink container. Then, of the corners β2 of the inner walls, some are completely away from the corresponding corners β1 of the outer walls. On the other hand, the corner α2 of the inner walls is positioned to be away from the corresponding corner al of the outer walls even in the last condition, hence becoming the portion that regulate the deformation of the inner walls to the last.

Further, in this condition, the pinch off portion 104 may be separated from the outer walls depending on the thickness of the inner walls. In such a case, the deforming direction is confined due to the length component which the pinch off portion 104 has. As a result, even when the fused portion should be dislocated from the outer walls, the deformation is not irregular, but it takes place while taking the balance.

Now, ink is contained in the ink container of the ink tank of the present invention, and led out from the ink supply portion thereof. Then, condition changes as has been described above. Therefore, the structure is arranged so that the deformation begins with the plane having the maximum area, and this plane is allowed to be in contact with facing plane before the edge formed by this plane and the adjacent plane is bent, and then, the corners other than the one which is formed by planes that constitute the ink supply portion are caused to shift. In this way, the priory is given to the deforming order when the ink tank is deformed.

Now, the description will be made of the method of manufacture embodying the present invention.

The ink tank provided by the invention hereof adopts the double wall structure in which the walls are formed by molding resin material and made separable from each other. Then, the outer walls are made thicker to provide strength. On the other hand, the inner walls are formed by softer material and made thinner so as to follow the voluminal changes of ink contained in the interior of the container. It is preferable to use material having resistance to ink for the inner walls, and one having resistance to shocks for the outer walls.

For the present embodiment, blow molding that uses blowing air is adopted as the method for manufacturing the ink tank. This is because the resin, which does not stretch essentially, is used for the walls that form the ink tank. Thus, it is arranged to enable the inner walls of ink tank that constitute the ink container to withstand the load which is given substantially equal in any direction. Therefore, the inner walls of the ink tank can reliably hold ink even when ink contained in the ink container by means of the inner walls may swing in any direction in condition that ink has been consumed to a certain extent, thus effectuating the overall durability of the ink tank.

As the blow molding method, there is the one that uses injection blowing, direct blowing, or double-wall blowing, among some others.

Now, the detailed description will be made of the manufacturing process that uses the direct blow molding in accordance with the present invention.

Figure 4:
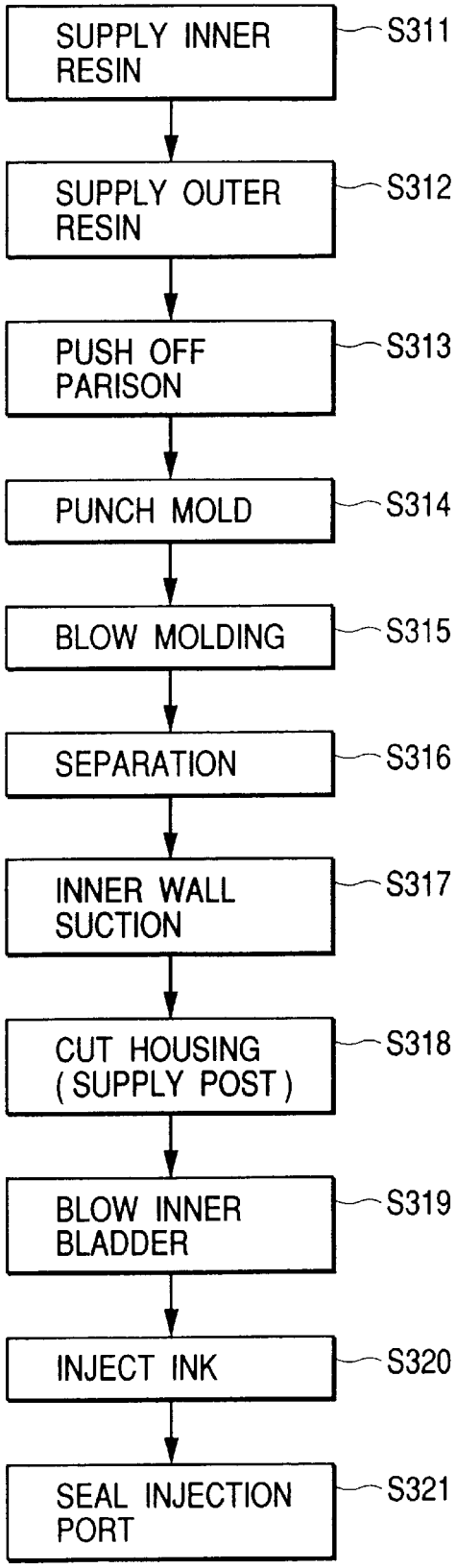
FIG. 4 is a flowchart which shows the procedures of ink tank manufacture.
Figure 5A:
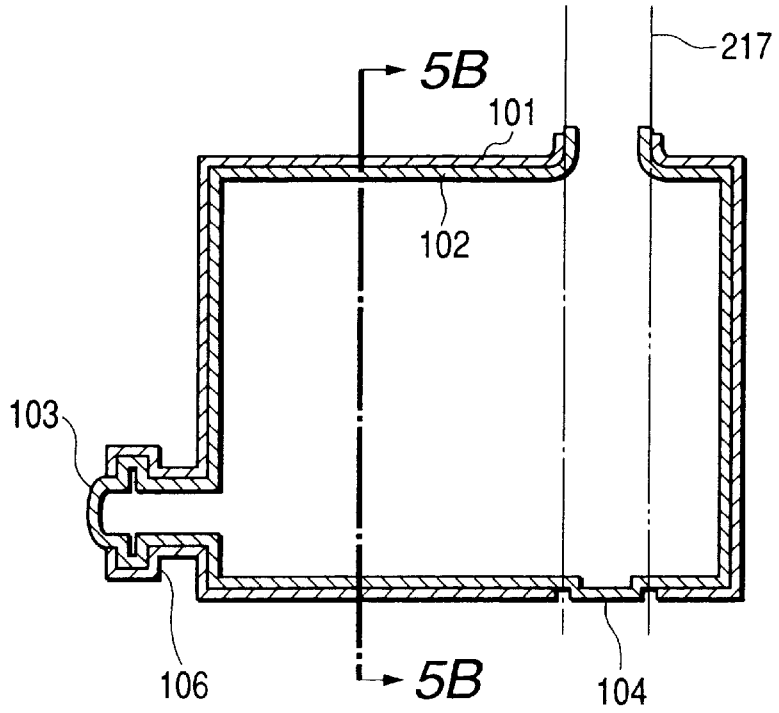
FIG. 5A is a view which shows the position of parison represented in FIGS. 3A to 3D and FIG. 4.
Figure 5B:
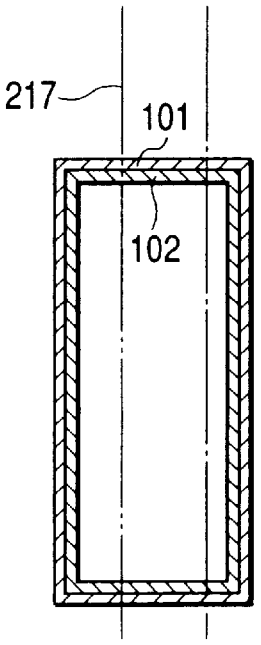
FIG. 5B is a cross-sectional view which is taken along line 5B—5B in FIG. 5A.

FIGS. 3A, 3B, 3C and 3D are views which illustrate the manufacturing process of the ink tank shown in FIG. 1. FIG. 4 is a flowchart which shows the procedures of ink tank manufacture. FIG. 5A is a view which shows the position of parison represented in FIGS. 3A to 3D and FIG. 4.

In FIGS. 3A, 3B, 3C, and 3D, a reference numeral 211 designates the main accumulator that supplies inner wall resin; 212, the main extruder that extrudes the inner wall resin; 213*a* and 213*b*, the sub-accumulators that supply outer wall resin; and 214*a* and 214*b*, the sub-extruders that extrude outer wall resin. At first, the injection nozzles are arranged to be the multiple ones so as to inject inner side resin and outer side resin into the die simultaneously for the preparation of the integrated body of first and second parisons. In this case, the supply of the inner side resin and that of the outer side resin may be in contact without any problem or none of them may be in contact without any problem, or the structure may be arranged so that a part of resin may be in contact. Here, in this case, material may be selected for the contacting planes of the inner side resin and the outer side resin so that resins are not allowed to be fused themselves or there is a need for adding chemical compound to one of resins when supplied into the die so that these are formed to be separable. Also, if material of the same group is needed in consideration of liquid contact with ink or configuration, it may be possible to supply resin to enable different materials to be positioned on the contacting planes by arranging the multiple layer structure for the inner side material or the outer side material. In this respect, although it is ideal to make the supply of the inner side resin uniform all around the circumference, the thickness is made locally smaller to easily follow the changes of inner pressure. The method for providing smaller thickness locally may be selected by the inner structure of the ink tank, but the structure should be arranged along the supply direction of resin to be supplied into the die.

Now, the inner side resin 217*b* and the outer side resin 217*a* are supplied (step S311 and step S312). Then, parison 217 is extruded (step S313).

Figure 3A:
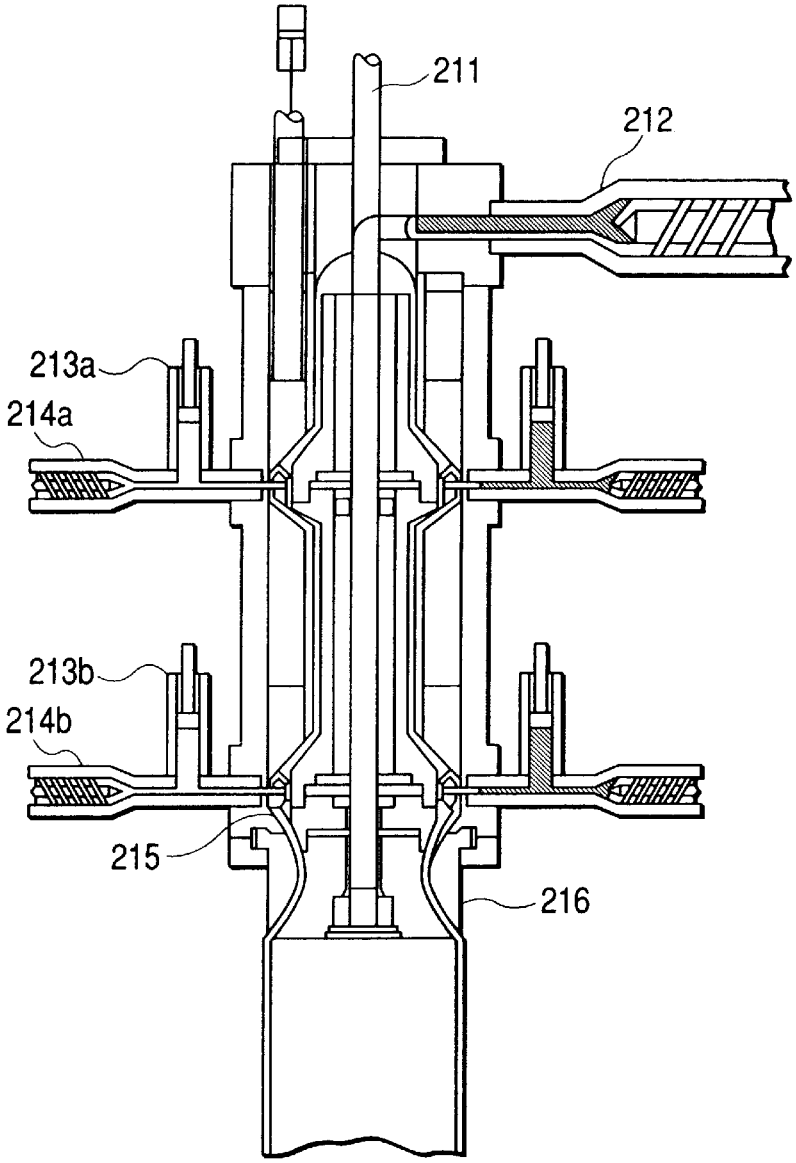
FIGS. 3A, 3B, 3C and 3D are views which illustrate the manufacturing process of the ink tank shown in FIG. 1.
Figure 3B:
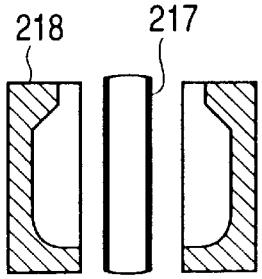
Figure 3C:
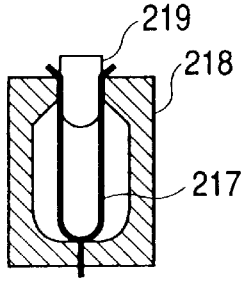
Figure 3D:
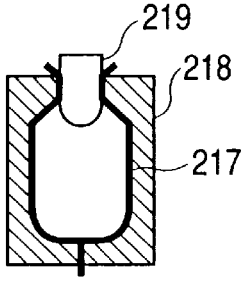

Then, the dies 218 which are arranged to nip the parison 217 shift from the state shown in FIG. 3B to the one shown in FIG. 3C to nip the parison 217 (step S314). Here, the position of the parison is near the ink injection port of an ink tank (see FIG. 5A).

Continuously, as shown in FIG. 3C, the air is injected through the air nozzle 219 to perform blow molding to configure the parison to match the shape of the metallic dies 218 (step S315). Since the ink supply port is far away from the position of the parison 217, the thickness becomes smaller in a state where the blown shape is formed (see FIG. 5A).

After that, the tank is released from the metallic dies (step S316), and the inner walls are peeled off from the outer walls on the supply port portion by suction or adsorption (step S317).

Then, the outer walls of the supply port are cut (step S318), and the inner walls are gain blown (step S319).

Thus, ink is injected (step S320), and the injection inlet is airtightly sealed (step S321). In this respect, as the method for sealing the injection inlet, there is the one in which the inner walls are fused directly or the one in which the injection inlet is sealed with separate material (such as rubber plug, film, cap), among some others.

Here, in accordance with the method of manufacture described above, the ink supply port and the ink injection inlet are formed each individually. However, it may be possible to form the ink supply port which has been closed by the inner walls of the ink tank so that it may dually function as the ink injection inlet. In this case, the inner wall surface of the ink supply port which has been once open for injecting ink should be closed again by welding. If the ink supply port and the ink injection inlet are arranged individually as in the present embodiment, it is possible to increase the freedom of configuring the ink supply port by forming the ink injection inlet by the utilization of the opening of parison as shown in FIG. 5A. Also, it becomes unnecessary to open the ink injection inlet when ink is injected. As a result, the liquid container can be manufactured more easily, and at the same time, ink leakage from the ink supply port can be prevented easily and reliably.

Now, the description will be made of the case where the ink tank shown in FIG. 1 is connected with a recording head.

Figure 6A:
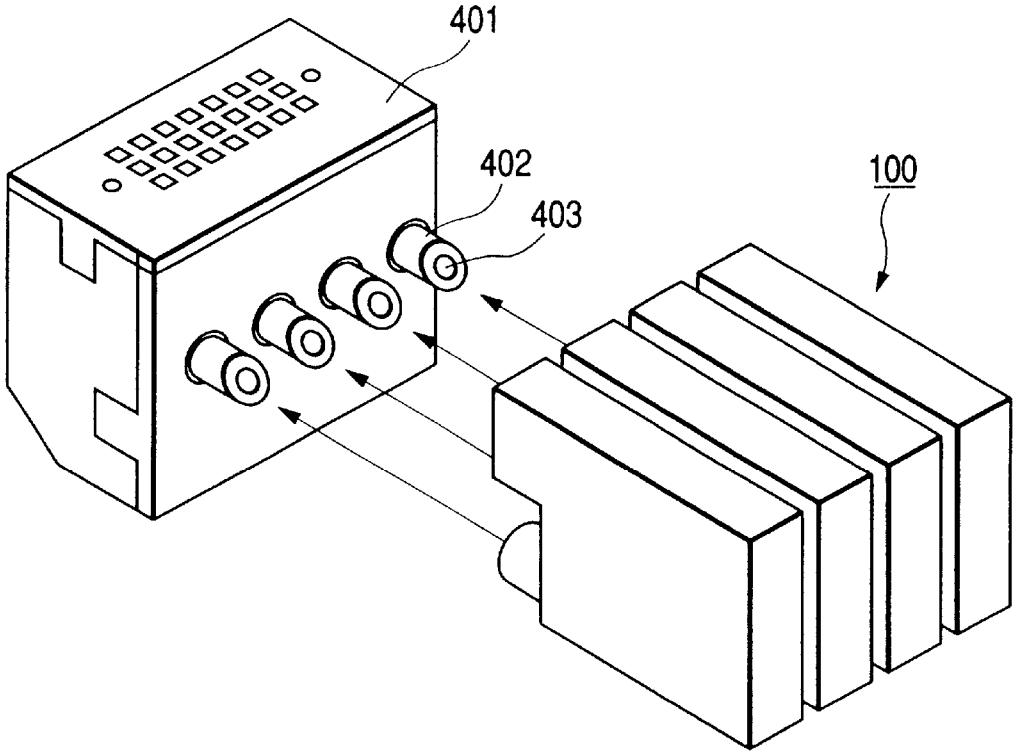
FIGS. 6A and 6B are views which illustrate the connection between the ink tank and a recording head which is recording means connectable therewith.
Figure 6B:
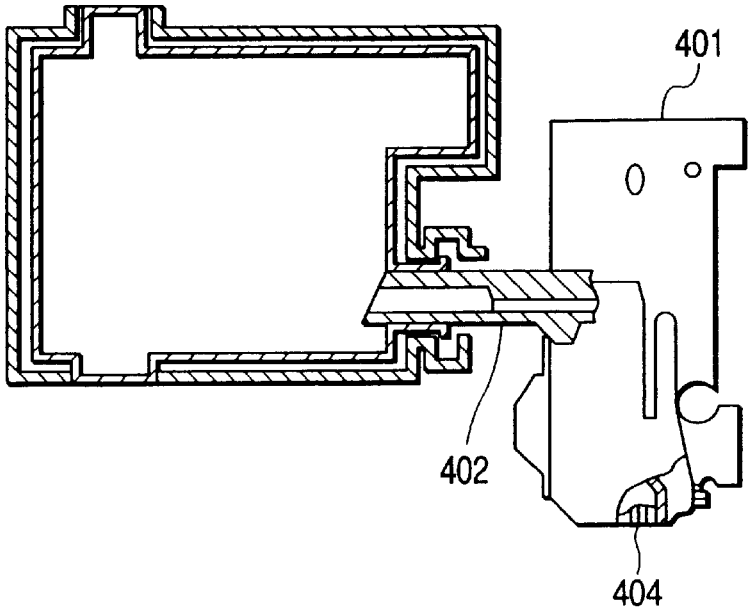

FIGS. 6A and 6B are views which illustrate the connection between the ink tank and a recording head which is recording means connectable therewith as shown in FIG. 1; FIG. 6A is a schematic view shoring the recording head serving as recording means connectable with the ink tank; FIG. 6B is a cross-sectional view which schematically shows the connecting condition between the recording head and the ink tank.

In FIG. 6A, a reference numeral 401 designates the recording head unit which serves as recording means. Then, the unit is assembled so that each of the recording heads for use of black, yellow, cyan, and magenta colors, respectively, is structured integrally together. Each of the recording heads is provided with liquid flow paths each having discharge port to discharge ink, and heat generating element for discharging ink from the aforesaid ink discharge port.

A reference numeral 402 designates each of the ink supply tubes that functions as ink induction unit to inducing ink into each of the recording heads. A filter 403 is provided for each end of the ink supply tubes 402 to trap bubbles and dust particles.

For the device which is provided with the ink tanks 100 and ink supply tubes 402, the ink supply tubes are needles or acute pipes, while each of the supply ports 103 of the ink tank 100 is formed thin by the method of manufacture described earlier. Moreover, with the sagging thin film, each of them may present the mode in which coupling is made easier still.

When the ink tank 100 is installed on this recording head unit 401, it becomes possible to supply ink through the ink supply tubes 402 which are connected with the ink tank 100 as shown in FIG. 6B.

Then, after the ink tank is installed, ink in the ink tank is induced into the recording head side by recovery means or the like provided for a recording apparatus (not shown), thus setting up the status of ink communication. After that, ink is discharged from the ink discharge unit 404 arranged for the recording head, while printing is in operation, to consume ink retained inside the ink tank inner walls 102.

Here, for the ink tank of the present invention, the ink supply portion is installed below the center of the ink tank. Therefore, it is unnecessary to adjust the discharge power on the recording head side, which may be required otherwise following the changes of ink remainders in the ink tank. The use efficiency of ink actually usable can also be improved.

Second Embodiment

Figure 7A:
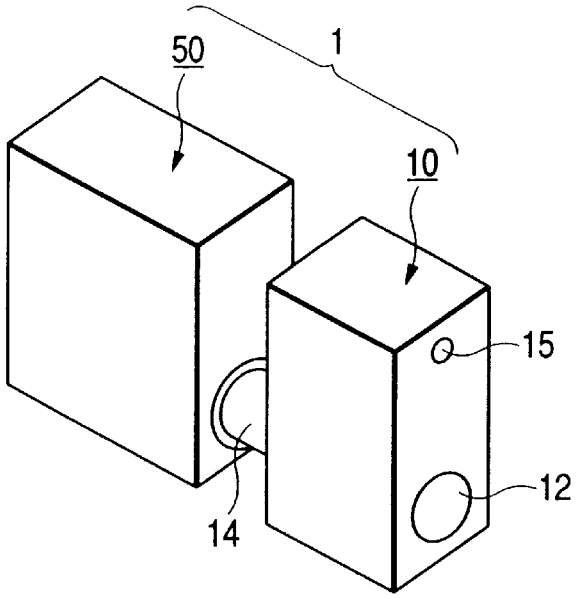
FIGS. 7A and 7B are views which schematically illustrate an ink tank to which is applied a liquid supply system of the present invention.
Figure 7B:
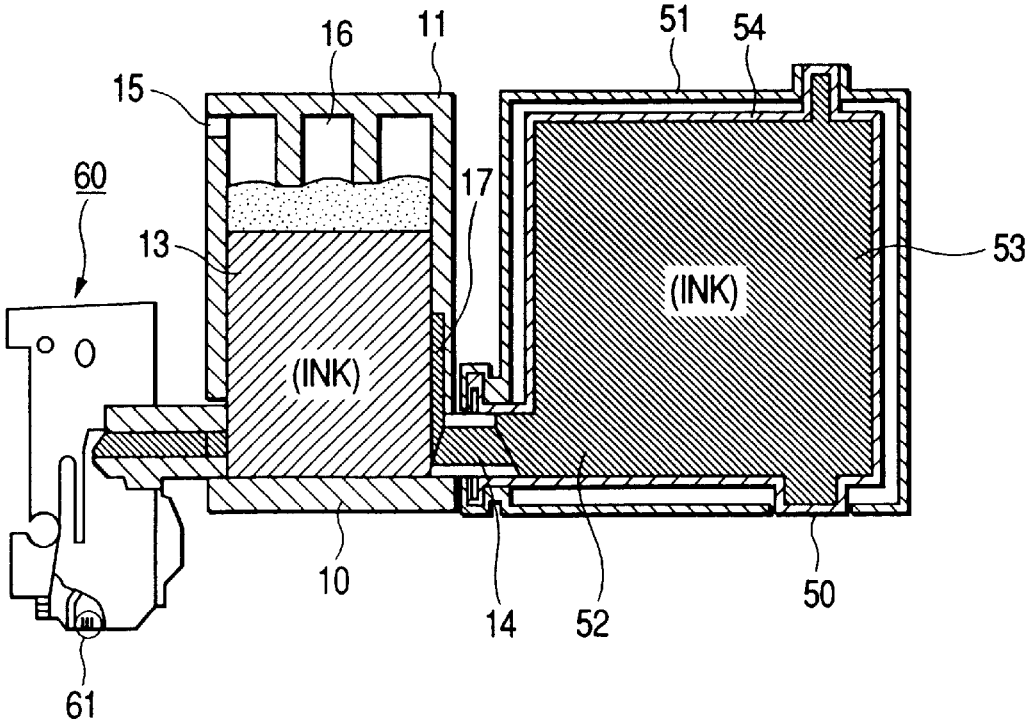

FIGS. 7A and 7B are views which schematically illustrate an ink tank to which is applied a liquid supply system of the present invention; FIG. 7A is a perspective view, and FIG. 7B is a cross-sectional view when the ink tank is connected with the recording head.

An ink tank 1 comprises a chamber 10 for containing a negative pressure generating member, and an ink containing chamber 50. The structure is arranged to make the ink containing chamber 50 separable from the chamber 10 for containing a negative pressure generating member through a communication tube (gas-liquid exchange passage) 14.

The chamber 10 for containing a negative pressure generating member comprises a housing 11 provided with an ink supply port 12 through which ink is supply externally to the recording head unit 60 or the like that records by discharging liquid from the discharge ports 61; the negative pressure generating member 13 formed by porous material, such as polyurethane form, to be contained in the housing; and a communication tube (gas-liquid exchange passage) 14 which is in contact with the negative pressure generating member for inducing liquid from a second chamber. The housing is further provided with a groove 17 for inducing the air outside on the inner side of the side walls near the communication tube for promoting the gas-liquid exchange which will be described later, and an atmospheric communication port 15 to communicate the negative pressure generating member contained in the ink container with the air outside. Then, in the vicinity of the atmospheric communication port 15, a buffer unit 16 is arranged, which is formed by ribs protruded from the inner faces of the housing. In accordance with the present embodiment, the gas-liquid exchange passage 14 abuts against the negative pressure generating member 13, and at the same time, the end portion thereof is connected with the groove 17 for inducing the air outside, hence making it possible to implement the liquid supply operation smoothly.

On the other hand, the ink containing chamber 50 comprises the housing (outer walls) 51 that constitutes a chamber; the ink containing chamber 53 which contains ink in the interior formed by the walls (inner walls) 54 having the inner faces which is equal or analogous to the inner faces of the housing; and ink lead out port 52 connected with the gas-liquid exchange passage 14, which leads out liquid from the liquid containing portion 53 to the chamber for containing a negative pressure generating member. For the present embodiment, an O ring or some other sealing member is provided for the connecting portion between the ink lead-out port 52 and the gas-liquid exchanging passage 14 to prevent the ink leakage from and the induction of the air outside into the connecting portion. It should be good enough if only the sealing member is provided either for the ink containing chamber side or the chamber for containing a negative pressure generating member side. In order to enhance the sealing capability, it may be possible to provide the sealing member for each side. Also, the sealing member may be provided independent from the ink containing chamber and the chamber for containing a negative pressure generating member, and then, arranged to be fitted into the connecting portion for both of them as the time of being coupled. The inner walls 54 are flexible, and the ink containing chamber 53 is made deformable following the leading out of ink contained in it. Also, the inner walls 54 are provided with the welding portion (pinch offs) 56. Then, the inner walls are supported in a mode in which to engage with the outer walls by the presence of this welding portion. Also, the atmospheric communication port 55 is provided for the outer walls to make it possible to induce the air outside into the gap between the inner walls and outer walls.

In this respect, the area where the negative pressure generating member retains ink is indicated by slanted lines in FIG. 7B and FIGS. 8A1, 8B1, and 8C1. Also, the ink, which is retained in the ink containing portion, the groove for inducing the air outside, the gas-liquid exchange passage, or some other space, is indicated by netted lines in FIG. 7B, FIGS. 8A1 to 8C1 and 8A2 to 8C2.

Here, the liquid containing chamber of the present embodiment is structured by the six planes that form a rectangular parallelepiped substantially, to which a cylindrical ink lead-out port 52 is added as a curved surface. The maximum surface area of this rectangular parallelepiped is indirectly represented in FIGS. 7A and 7B. Then, the thickness of the inner walls 54 is smaller on the vertex portions (hereinafter referred to as the "corners" including the case where the vertex portions form a minutely curved-surface shape) than each central portion of the planes that form the rectangular parallelepiped. The thickness is gradually made smaller from each of the central portions to each of the corners to present a convex shape on the inner side of the ink container. This direction is, in other words, the same as the direction of deformation of each plane, which produces an effect in promoting the deformation to be described later.

Also, since the corners of the inner walls are formed by three faces, the resultant strength of the caners of the inner walls is made greater than that of the central portions. Also, in terms of the surface extension, the thickness of the corners is smaller than that of the central portions, thus allowing the each of the planes to move. Here, it is preferable to make the thickness of the portions that form each of the corners substantially equal, respectively.

Now, since FIGS. 7A and 7B are schematic views, the positional relations between the outer walls 51 and inner walls 54 of the ink containing chamber are represented as if these walls are apart from each other with a gap. In practice, however, the outer and inner walls may be made either separable or in contact with each other or may be structured to be arranged with a slight gap.

The aforesaid ink tank is structured to make the ink containing chamber exchangeable with the chamber containing a negative pressure generating member. At first, therefore, the description will be made of the state of each chamber when the ink containing chamber is connected with the chamber for containing a negative pressure generating member in conjunction with FIGS. 8A1, 8B1, 8C1, 8A2, 8B2, and 8C2.

FIGS. 8A1, 8A2, 8B1, 8B2, 8C1, and 8C2 are views which illustrate one example of the changes of each chamber when the ink tank containing chamber of the ink tank shown in FIGS. 7A and 7B is connected with the chamber for containing a negative pressure generating member. FIGS. 8A1 to 8C1 are cross-sectional views taken on the same section as shown in FIG. 7B. FIGS. 8A2 to 8C2 are cross-sectional views corresponding to the liquid containing chamber shown in FIGS. 8A1 to 8C1.

FIGS. 8A1 and 8A2 are views which illustrate the chamber for containing a negative pressure generating member and the ink containing chamber before coupling. Here, for the ink lead-out port 52 of the liquid container chamber 50, sealing means 57 (film or the like, for instance) is provided to prevent the leading-out of ink contained in the ink containing portion in order to maintain the airtight condition of the ink containing portion of the liquid containing chamber against the air outside. Also, the inner walls 54 that constitutes the ink containing portion are formed in such a manner that the inner walls are configured to follow the inner shape of the housing (outer walls) 51, and that the corners of the inner walls are placed at least at the corners of the outer walls (this is called the "initial condition").

In this case, with ink being retained in the ink containing portion in an amount slightly less than the full amount that can be stored in that portion so that negative pressure is exerted at the ink lead-out port when sealing means is released, it becomes possible to reliably prevent ink from leaking out due to external force, temperature changes, or atmospheric changes at the time of releasing sealing means.

Also, with such environmental changes in view, it is preferable to keep the amount of the air in the ink containing portion extremely small before this portion is connected with the chamber for containing a negative pressure generating member. In order to reduce the air amount retained in the ink containing portion, it should be good enough to adopt such method of liquid injection as disclosed in the specification of Japanese Patent Laid-Open Application 10-175311, for example.

On the other hand, in FIG. 8A1, the negative pressure generating member in the chamber for containing a negative pressure generating member retains ink in a part thereof. In FIG. 8A1, it is shown that the ink interface in the negative pressure generating member is lower than the groove for inducing the air outside. Then, the groove for inducing the air outside is communicated with the air outside through the negative pressure generating member.

Here, the amount of ink retained in the negative pressure generating member is dependent on the amount of ink that has been retained in the negative pressure generating member at the time of exchanging the ink containing chambers, which will be described later. Therefore, a light variation thereof is allowable. it is not necessary to keep ink in an uniform condition under any circumstance, and also, the groove for inducing the air outside and the gas-liquid exchange passage are not necessarily filled with liquid. The air may be contained ass shown in FIG. 8A1.

Now, as shown in FIGS. 8B1 and 8B2, the ink containing chamber is connected with the chamber for containing a negative pressure generating member. At this juncture, ink is allowed to shift as indicated by an arrow in FIG. 8B1 until pressures in the chamber for containing a negative pressure generating member and the ink containing chamber are equalized. Then, as shown in FIGS. 8C1 and 8C2, with the pressure on the ink supply port 12 becoming negative, equilibrium is conditioned (this is called the "condition of use initiation").

Now, the detailed description will be made of ink shift for obtaining the equilibrium condition.

As shown in FIG. 8B1, when the gas-liquid exchange passage 14 of the chamber for containing a negative pressure generating member is inserted into the ink lead-out port 52 of the ink containing chamber, the seal of the sealing means 57 is released. Then, since the connecting portion is sealed by sealing means described earlier, there is no possibility that ink leaks from the connecting portion or the air outside enters from the connecting portion directly into the ink containing chamber. Therefore, with the exception of the gas-liquid exchange passage 14, the ink containing chamber becomes airtight essentially.

Then, ink in the ink containing chamber 53 is allowed to flow into the gas-liquid exchange passage 14 to form the ink path between this chamber and the negative pressure generating member 13 in the chamber for containing a negative pressure generating member. When the ink path is formed, ink shift begins to take place from the ink containing chamber to the negative pressure generating member by means of the capillary force of the negative pressure generating member as shown in FIG. 8B1. As a result, the interface of the negative pressure generating member is raised. Also, the inner walls 54 tend to begin deforming from the central portion of the plane having the maximum area in the direction in which the volume of the ink containing portion 53 is reduced.

Here, the outer walls 51 function to suppress the displacement of the corners of the inner walls 54. Then, with the active force exerted by the deformation caused by the consumption of ink in the ink containing portion, and the active force exerted by that portion which tends to return to the shape in the initial state (FIGS. 8A1 and 8A2), negative pressure is being exerted corresponding to the degree of deformation without any abrupt changes. The space between the inner walls and the outer walls is communicated with the air outside through the atmospheric communication port 55, thus inducing the air into such space between the inner walls 54 and the outer walls 51 in accordance with the deformation described above.

Here, in FIG. 8A1, even if the air is present in the gas-liquid exchange passage, the ink path is formed when ink in the ink containing portion is in contact with the negative pressure generating member. Then, the ink containing portion is deformed as ink is led out, thus making it easier to shift the air to the ink containing portion 53.

Also, as to the ink induction into the groove for inducing the air outside, ink can be filled in it if the capillary force of the groove for inducting the air outside is greater than the negative pressure exerted by the ink containing portion as in the present embodiment.

When ink shift begins, and ink is being filled in the negative pressure generating member, ink is filled even above the upper end portion of the groove for inducing the air outside as shown in FIG. 8C1. Thus, the groove for inducing the air outside is no longer communicated with the air outside.

Then, the ink containing chamber conducts the exchange of ink and the air only through the chamber for containing a negative pressure generating member. As a result, ink shift is made more so as to equalize the static negative pressure of the gas-liquid exchange passage of the ink containing chamber with the static negative pressure of the gas-liquid exchange passage of the chamber for containing a negative pressure generating member.

In the case which is shown in FIG. 8C1, the negative pressure in the chamber for containing a negative pressure generating member is greater than the negative pressure in the ink containing chamber. Therefore, ink shifts more from the ink containing chamber to the chamber for containing a negative pressure generating member until the negative pressure on both sides become equal. Along with this shift, the amount of retained ink is increased in the negative pressure generating member of the chamber for containing a negative pressure generating member.

As described above, the ink shift from the ink containing chamber to the chamber for containing a negative pressure generating member is carried out without induction of the air into the ink containing chamber through the negative pressure generating member when both of them are connected. Then, it should be good enough to set the static negative pressure in each of the chambers at an appropriate value in accordance with the kind of liquid discharge recording means with which each chamber is connected when equilibrium is reached so that ink is not allowed to leak from the liquid discharge recording means (not shown) such as a recording head which is connected with the ink supply port.

The lower limit of the amount of ink which is shiftable from the ink containing portion is the amount of ink which is filled in the negative pressure generating member up to the upper level (the gas-liquid interface to be described later) of the groove for inducing the air outside. The upper limit is the amount of ink when the negative pressure generating member is filled with ink completely. Therefore, with consideration given to the fluctuation of the amount of ink to be retained in the negative pressure generating means before connection, it becomes possible to select the material of the ink containing portion and the thickness thereof appropriately, which are suitable for the negative pressure generating member, on the basis of the negative value a in the ink amounts and the equilibrium condition if the amount of ink shiftable to the negative pressure generating member is determined from these upper limit and lower limit of the amount of ink.

Also, since the amount of ink retained in the negative pressure generating member fluctuate before connection, there still remains the region where ink is not filled in the negative pressure generating member even after the equilibrium condition has been reached in some cases as shown in FIGS. 8C1 and 8C2. Such region may be utilized as a buffer region together with the buffer portion in order to cope with the changes of temperature or pressure to be described later.

Now, in accordance with each of the embodiments described above, the interface between the outer walls that provide strength as a housing and the inner walls which are excellent in resistance to ink and barrier capability against gas for containing ink in the interior formed thereby is formed by a material which is at least separable. Therefore, the inner walls can be deformed along with the leading-out of ink from the ink containing portion formed by the inner walls, hence making it possible to generate negative pressure suitably usable for an ink jet recording head.

On the other hand, it may be possible to form them by the material which cannot be made separable by selecting each of the materials appropriately, while keeping the physical properties of the outer walls and inner walls remain unchanged. With the inner and outer walls being inseparable, it is difficult to use the ink tank the structure of which is formed as in the first embodiment. However, this arrangement is applicable to the second embodiment unless the effect described in conjunction with FIGS. 8A1 to 8C1 and 8A2 to 8C2 is anticipated. With this structure, the seal of the supply port portion is formed only with the inner walls the strength of which weaker. Then, there is an advantage that the seal of the supply port portion can be broken easily as required by use of a hollow needle or the like. This arrangement may be applicable to a container as a whole, such as the one that contains liquid (seasoning such as a dressing or as beverage) usable in the other fields than the ink jet recording. (Liquid Discharge Recording Apparatus)

Figure 9:
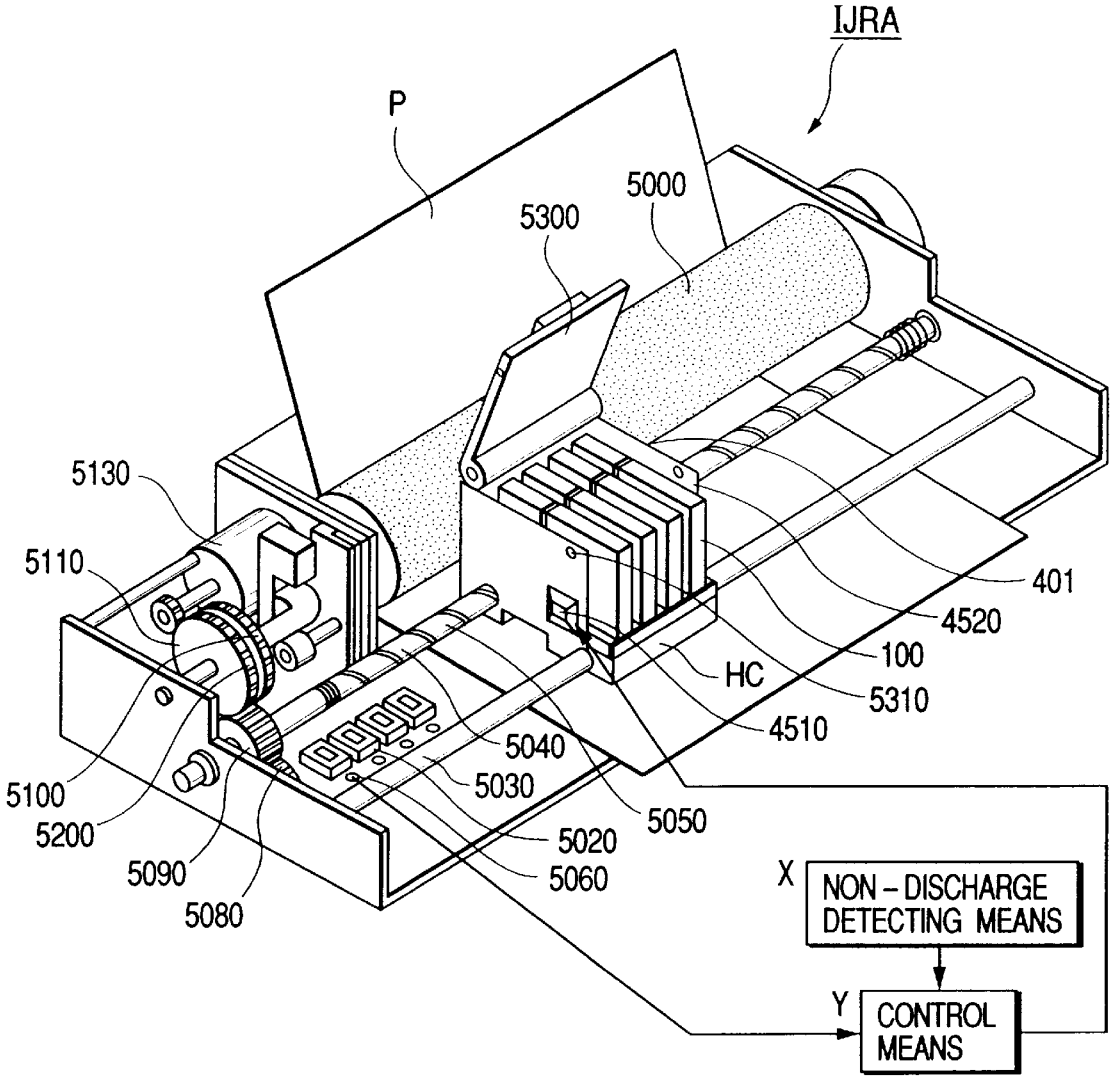
FIG. 9 is a view which schematically shows an ink jet recording apparatus having on it the ink tank represented in FIG. 1.

Hereinafter, the description will be made of an ink jet recording apparatus having mounted thereon the ink tank shown in FIG. 1 to perform recording. FIG. 9 is a view which schematically shows the ink jet recording apparatus that mounts thereon the ink tank represented in FIG. 1.

In FIG. 9, a head unit (not shown) and an ink tank 100 is fixedly supported on the main body of an ink jet recording apparatus by positioning means (not shown) of the carriage 4520 and by the connecting plate 5300 which rotates around a predetermined axis. At the same time, the unit and tank are detachably installed on the carriage, respectively. The regular and reverse rotations of a driving motor 5130 are transmitted to a lead screw 5040 through the driving transmission gears 5110 and 5090 to rotate it. Also, the carriage 4520 is provided with a pin (not shown) that engages with the spiral groove 5050 of the lead screw 5040. With this arrangement, the carriage 4520 reciprocates in the longitudinal direction of the apparatus.

A reference numeral 5020 designate a cap that caps the front face of each of the recording heads in the recording head unit. By use of suction means (not shown), the cap is used for the suction recovery of each recording head through the inner aperture of each cap. Each of the caps 5020 can move to cover each discharge port surface of recording heads by means of the driving power transmitted through the gear 5080 and others. In the vicinity of each cap 5020, the cleaning blade (not shown) is supported to be movable in the vertical direction in FIG. 9. Each of the blades is not necessarily limited to this configuration. It is of course possible to adopt any of the known cleaning blades for the present embodiment.

Here, the description will be made of the advantages obtainable when the ink tank of the invention hereof is mounted on the carriage that reciprocates in such a manner as described above.

Here, the arrangement is made so that a desired process is carried out for capping, cleaning, and suction recovery on the corresponding positions by the function of the lead screw 5050 when the carriage 4520 moves to the home position thereof. However, if only the desired operation can be made executable at known timing, a structure may be arranged in any way and made applicable to the present embodiment.

The ink containing chamber of the ink tank of the invention hereof is formed by a deformable material to make it possible to relax the swinging of ink caused by the scanning of the carriage by the deformation of the ink containing portion. In order not to generate any fluctuation of negative pressure owing to a scanning of the carriage of the kind, it is desirable to enable a part of corners of the ink containing portion to keep its position to the inner face of the housing so that it does not part from the inner face thereof or to be positioned near to it even if such part of the corners is caused to part from the inner face of the housing. Also, as to the ink containing portion of the present embodiment, which has a pair of planes of the maximum areas to face each other, it becomes possible to demonstrate such relaxing effect on ink swinging more effectively by mounting the carriage in such a manner that the planes having the maximum areas to face each other are positioned in the direction substantially orthogonal to the scanning direction of the carriage.

Also, it may be possible to mount on a recording apparatus the pressure recovery means 4510 that presses the inner walls through the outer walls of the ink containing chamber. In this case, with the provision of liquid remainder detection means 5060 whereby to transmit light through the ink containing chamber, and provide light emitting means and light receiving means for detecting the presence and absence of ink by the condition of light reflection, as well as with the provision of non-discharge detection means X that detects non-discharges of the recording head and control means Y, it becomes possible to eliminate ink shortage in the range from the vicinity of the gas-liquid exchange passage of the negative pressure generating member to the vicinity of the ink supply port portion if only the following sequence is adopted:

At first, when ink containing chambers are replaced, the usual suction recovery is executed by use of the cap 5020. Then, if non-discharges are detected for the nozzles of the head corresponding to the ink containing chamber thus replaced, it is possible to recover such condition to the normal one by performing the pressure recovery operation using pressure recovery means 4510. Also, on the way of use, the condition of "ink present " is detected by the liquid remainder detection means, and the "non-discharge " condition is detected by the non-discharge detection means for the nozzle of the corresponding head, respectively, and then, non-discharge is not recovered by the usual operation of the suction recovery. Even in such case, it is possible to restore the condition to the usual one by executing the pressure recovery operating using the pressure recovery means 4510. In either case, it is preferable to prevent any unexpected ink leakage by capping the recording head unit corresponding to the ink tank for which the pressure recovery is needed.

In this respect, the liquid remainder detection means is not necessarily of optical type as described above. It may be possible to adopt a dot-counting type or some other ones or to combine some of them for use.

Further, for the liquid container of each of the embodiments described above, there is a fear that ink leaks from the container if attaching and detaching are repeated on the way of use after it has been installed on a recording head. Therefore, it is desirable to prohibit any replacement until ink is completely consumed by use of the control means Y once it is installed on the recording head. More specifically, the replacement of the liquid containers is made possible only when the carriage is in the position where the containers are allowed to be replaced, and at the same time, a structure is arranged so that a main body sequence is established so as to enable a liquid container to be moved to the position where the replacement of liquid containers is allowed only when the liquid remainder detection means 5060 has detected liquid no longer. Also, it may be possible to arrange to release the lock 5310 of the cover 5300 that fixes the liquid containers when the complete consumption of liquid is ascertained in accordance with the detected result of the liquid remainder detection means 5060, hence making the replacement of liquid containers possible.

What is claimed is:

1. A liquid container substantially in a polyhedral form with the corners formed by the extended portions of the three planes of said polyhedral form, comprising:

outer walls having strength to form a housing;

inner walls having the outer plane equal to or analogous to the inner plane of said outer walls with the corners corresponding to the corners of said outer walls to form a liquid containing portion capable of containing liquid in the interior formed thereby, having strength smaller than that of said outer walls; and a liquid supply portion for supplying liquid contained in said liquid containing portion to the outside, wherein said liquid supply portion is sealed only by said inner walls.

2. A liquid container according to claim 1, wherein the interface between said outer walls and said inner walls is formed at least by separable material, and at the same time, an atmospheric communication portion is provided for said outer walls to induce the air outside into the gap between said outer walls and said inner walls.

3. A liquid container according to claim 1, wherein said inner walls of the liquid supply portion protrude to the outer side from the edge of the outer walls of said liquid supply portion.

4. A liquid container according to claim 1, wherein said inner walls of the liquid supply portion has sagging portion.

5. A liquid container according to claim 1, wherein said inner walls and outer walls are provided with the planes each having the maximum area on the planes other than the planes having said liquid supply portion arranged thereon.

6. A liquid container according to claim 5, wherein on the plane other than said planes having the maximum areas, a pinch off portion is arranged with the portion integrally formed with said inner walls being pinched by the outer walls, and at the same time, said pinch off portion is arranged on the plane intersecting the planes having said liquid supply portion.

7. A liquid container according to claim 6, wherein a liquid injection inlet for injecting liquid into said liquid containing portion is arranged on the plane facing the plane having said pinch off portion.

8. A liquid container according to claim 6, wherein said inner walls are physically separated from the outer walls with the exception of the pinch off portion.

9. A liquid container according to claim 1, wherein on said liquid containing portion side having the inner walls of said liquid supply port portion being sandwiched therebetween, an inner wall receiving plane is provided for preventing the inner walls of said liquid supply portion from falling off into said liquid containing portion.

10. A liquid container according to claim 9, wherein said inner wall receiving plane is formed in plural steps.

11. An ink jet cartridge comprising:

a liquid container for containing liquid; and a recording head unit connected with said liquid container for discharging liquid in accordance with recording signals, wherein said recording head unit is provided with a recording head for discharging liquid;

a chamber for containing a negative pressure generating member having a liquid supply portion for supplying liquid to said recording head, and an atmospheric communication unit communicated with the air outside to contain therein a negative pressure generating member capable of retaining liquid in the interior thereof, and said liquid container is provided with outer walls in a substantially polyhedral form, having corners formed by extended portions of the three planes of said polyhedron, at the same time, having strength to form a housing;

inner walls having the outer plane equal to or analogous to the inner plane of said outer walls with the corners corresponding to the corners of said outer walls to form a liquid containing portion capable of containing liquid in the interior formed thereby, having strength smaller than that of said outer walls; and a liquid supply portion for supplying liquid contained in said liquid containing portion to the outside, and said liquid supply portion is sealed only by said inner walls, and at the same time, said liquid container is attachable to and detachable from said chamber for containing a negative pressure generating member.

12. An ink jet recording apparatus comprising:

an ink jet cartridge provided with a liquid container for containing liquid, and a recording head unit connected with said liquid container for discharging liquid in accordance with recording signals; and a carriage having said cartridge detachable mounted thereon to perform scanning, wherein said liquid container is provided with outer walls in a substantially polyhedral form, having corners formed by extended portions of the three planes of said polyhedron, at the same time, having strength to form a housing;

inner walls having the outer plane equal to or analogous to the inner plane of said outer walls with the corners corresponding to the corners of said outer walls to form a liquid containing portion capable of containing liquid in the interior formed thereby, having strength smaller than that of said outer walls; and a liquid supply portion for supplying liquid contained in said liquid containing portion to the outside, and said liquid supply portion is sealed only by said inner walls, and at the same time, when said liquid container is installed on said recording head, the detaching thereof from said recording head is prohibited until liquid in the interior thereof is no longer present.

13. An ink jet recording apparatus according to claim 12, wherein said carriage is located on the replacement position after liquid in said liquid container is no longer present.

14. An ink jet recording apparatus according to claim 12, wherein said liquid container is fixed on said carriage, and remains to be fixed until liquid in the interior thereof is no longer present.

* * * * *

UNITED STATES PATENT AND TRADEMARK OFFICE

CERTIFICATE OF CORRECTION

PATENT NO. : 6,435,673 B1
DATED : August 20, 2002
INVENTOR(S) : Shozo Hattori et al.

It is certified that error appears in the above-identified patent and that said Letters Patent is hereby corrected as shown below:

Title page,
Item [57], ABSTRACT,
Line 4, “including” should read -- includes --.

Column 2,
Line 54, “detachable” should read -- detachably --.

Column 3,
Line 19, “exits.” should read -- exists. --; and
Line 41, “shoring” should read -- showing --.

Column 4,
Line 44, “can” should read -- can be --; and
Line 60, “which” should read -- which is --.

Column 5,
Line 1, “wall” should read -- walls --;
Line 3, “is” should read -- are --;
Line 25, “layer the” should read -- layer that --;
Line 51, “portions, a” should read -- portions, α --; and
Line 61, “curbed” should read -- curved --.

Column 6,
Line 2, “begins” should read -- begin --;
Line 5, “functions” should read -- function --;
Line 10, “trends” should read -- tends --; and
Line 13, “form” should read -- from --.

Column 7,
Line 34, “corner al” should read -- corner α1 --;
Line 35, “regulate” should read -- regulates --; and
Line 53, “priory” should read -- priority --.

Column 9,
Line 38, “shoring” should read -- showing --;
Line 48, “discharge” should read -- a discharge --; and
Line 49, “heat” should read -- a heat --.

Column 10,
Line 29, “supply” should read -- supplied --; and
Line 34, “form,” should read -- foam, --.

UNITED STATES PATENT AND TRADEMARK OFFICE

CERTIFICATE OF CORRECTION

PATENT NO. : 6,435,673 B1
DATED : August 20, 2002
INVENTOR(S) : Shozo Hattori et al.

It is certified that error appears in the above-identified patent and that said Letters Patent is hereby corrected as shown below:

Column 11,
Line 8, “as the” should read -- at the --;
Line 42, “caners” should read -- corners --; and
Line 45, “the” (second occurrence) should be deleted.

Column 12,
Line 16, “constitutes” should read -- constitute --;
Line 50, “it is” should read -- It is --;
Line 50, “in an” should read -- in a --; and
Line 54, “ass” should read -- as --.

Column 14,
Line 4, “become” should read -- becomes --;
Line 32, “value a” should read -- value α --;
Line 35, “these” should read -- the --; and
Line 60, “remain” should be deleted.

Column 15,
Line 1, “weaker.” should read -- is weaker. --; and
Line 25, “designate” should read -- designates --.

Column 18,
Line 27, “detachable” should read -- detachably --.

Signed and Sealed this

Eighteenth Day of March, 2003

JAMES E. ROGAN
*Director of the United States Patent and Trademark Office*